US006397959B1

(12) United States Patent
Villarreal

(10) Patent No.: US 6,397,959 B1
(45) Date of Patent: Jun. 4, 2002

(54) MILL

(76) Inventor: Ramiro Bazan Villarreal, 270CR325, Alice, TX (US) 78332

( * ) Notice: Subject to any disclaimer, the term of this patent is extended or adjusted under 35 U.S.C. 154(b) by 0 days.

(21) Appl. No.: 09/573,099

(22) Filed: May 17, 2000

(51) Int. Cl.[7] ..... E21B 29/06
(52) U.S. Cl. ..... 175/393; 175/394; 166/55
(58) Field of Search ..... 166/55, 298; 175/327, 175/393, 394

(56) References Cited

U.S. PATENT DOCUMENTS

| | | | | |
|---|---|---|---|---|
| 623,506 | A | | 4/1899 | Baker |
| 713,067 | A | | 11/1902 | Cowles |
| 1,133,162 | A | | 3/1915 | McAllister |
| 1,370,677 | A | | 3/1921 | Wooldridge |
| 1,602,794 | A | | 10/1926 | Erwin |
| 1,703,390 | A | | 2/1929 | Duffy |
| 1,734,469 | A | | 11/1929 | Journeay |
| 2,425,132 | A | | 8/1947 | Stokes |
| 2,557,751 | A | | 6/1951 | Melzer |
| 2,749,102 | A | | 6/1956 | Goodrich |
| 2,790,623 | A | | 4/1957 | Pate |
| 2,838,284 | A | | 6/1958 | Austin |
| 3,074,240 | A | * | 1/1963 | Elliott |
| 3,172,489 | A | | 3/1965 | Jones |
| 3,338,069 | A | | 8/1967 | Ortloff |
| 3,360,960 | A | | 1/1968 | Massey |
| 4,393,947 | A | | 7/1983 | Lutze et al. |
| 4,406,336 | A | | 9/1983 | Olsen et al. |
| 4,610,316 | A | | 9/1986 | Boaz |
| 4,854,399 | A | | 8/1989 | Zijsling |
| 5,265,688 | A | | 11/1993 | Rumpp et al. |
| 5,769,166 | A | * | 6/1998 | Duke ..... 166/298 |
| 5,894,889 | A | * | 4/1999 | Dewey et al. ..... 166/298 |
| 6,202,752 | B1 | * | 3/2001 | Kuck et al. ..... 166/298 |
| 6,209,645 | B1 | * | 4/2001 | Ohmer ..... 166/298 |

* cited by examiner

*Primary Examiner*—David Bagnell
*Assistant Examiner*—Jennifer R. Dougherty
(74) *Attorney, Agent, or Firm*—George S. Gray

(57) ABSTRACT

A mill is provided for grinding and cutting objects in various wells, such as oil wells, which will typically have a cement plug or a metallic item of debris which must be ground into small enough particles to be circulated out of the hole by circulation fluid pumped through the mill. Helical water-courses have been added to the body of the mill that improves the ability of the circulation fluid to move milled particles beyond the mill. Reverse ports are also provided which divert a portion of the pressurized circulation fluid from the mill interior to the annulus adjacent the mill. The reverse ports are threaded to be closable by a corresponding set screw. An optimized configuration of carbide cutting inserts, attached as part of the mill's grinding tips, is also provided.

32 Claims, 9 Drawing Sheets

PRIOR ART

MILL

BACKGROUND OF THE INVENTION

1. Field of the Invention

The present invention relates generally to removing obstacles in oil wells, gas wells, water wells, and from the annulus of other holes, by grinding and cutting the obstacle with a mill. Typically, the mill is attached to a mud motor that rotates the mill at high speed. Coiled tubing is often used to deliver fluid through the mud motor, through the mill, then up the annulus surrounding the coiled tubing to the surface. The circulating fluid, which is typically fresh water or salt water, transports the milled obstacle particles to the surface.

2. Description of the Prior Art

There have been mills available for several years that have several common features including a threaded top end for attachment to the mud motor, a neck, a body, several blades, a special grinding material attached to the blades to form tips, a central hole through the top end, the neck and body, leading to tip ports such that the circulation fluid exits the tip ports, and vertical watercourses on the body which generally provide a path for the circulation fluid to move from the tips and past the body. Carbide cutting inserts have been attached to the blades prior to adding the grinding material for better cutting performance.

No prior mills have optimally addressed the problem of milled particles clogging the tip ports, the vertical watercourses, and the annulus about the tips, body and neck, nor have prior mills optimized the number and configuration of the cutting inserts.

What is needed is a mill that maximizes the ability of the circulation fluid to remove milled particles from the mill to the surface, and optimizes the configuration of the cutting inserts.

SUMMARY OF THE PRESENT INVENTION

The present invention is an improved mill for grinding and cutting obstacles in oil wells, gas wells, water wells, and from the annulus of other holes. Such obstacles can include plugs made from aluminum, cast iron, metal, and combined metals, as well as, cement and cemented coil tubing. The improvements overcome the shortcomings of the prior art by providing an improved ability of the circulation fluid to move milled particles from the mill to the surface.

One aspect of the improvement is to change the vertical configuration of the watercourses, to a helical configuration. This improvement substantially enhances the ability of the circulation fluid to carry milled particles from the mill tip area past the body. For the high rotation speed mill, this helical path cut in the body, allows a substantially smoother path for the milled particles to follow since the trailing edge of the watercourse presents a sloped face to the particles instead of a perpendicular face. The particles naturally follow the slope as the mill rotates, instead of being held against the watercourse trailing edge until more particles or circulation fluid forces them along the watercourse. The circulation fluid itself also moves through the helical watercourses with less turbulence, thus increasing its circulation rate.

Another enhancement to the circulation fluid's ability to move the milled particles, is the provision of reverse ports. In prior art mills, all circulation fluid was required to exit through the mill ports. In the present invention reverse ports are provided that exit the central hole near the mid-point of the body, and then exit the body near the point where the watercourse terminates near the neck. Both the U-tube effect from the column of circulation fluid and the backpressure caused by the tip ports, result in a portion of the circulation fluid being forced through the reverse ports. This portion of the circulation fluid exits the mill and creates turbulence as it joins other circulation fluid moving along the annulus and through the watercourses. This turbulence aids in preventing accumulations of milled particles in the neck area.

The configuration of cutting inserts on the blades are also optimized.

A mill is provided for grinding objects in wells, the mill being of the type having an attachment end, a neck, a body, watercourses on the body, blades, tips formed from grinding material on the blades, a central hole through the neck, and body, and tip ports in fluid communication with the central hole such that fluids can be circulated through the mill, the mill being rotated during grinding in a generally counterclockwise direction when viewed from the bottom, wherein the improvement comprises, the watercourses, each watercourse having a first end, each first end being proximate a tip port, each watercourse further having a second end, each second end being proximate the neck, and further each watercourse being generally helical from the first end to the second end, the watercourse first end leading the second end during grinding.

The foregoing mill also comprises at least one cutting insert attached to one or more of the blades.

A mill is provided for grinding objects in wells, the mill being of the type having an attachment end, a neck, a body, watercourses on the body, blades, tips formed from grinding material on the blades, a central hole through the neck, and body, and tip ports in fluid communication with the central hole such that fluids can be circulated through the mill, wherein the improvement comprises, the body, the body further comprising at least one reverse port, each reverse port exiting the mill central hole from within the body, and exiting the mill at a point higher than the point of exit from the central mill hole.

The foregoing mill may also include at least one cutting insert attached to one or more blades.

The foregoing mill may also include each reverse port exiting the mill proximate the neck and proximate one of the watercourses.

A mill is provided for grinding objects in wells, the mill being of the type having an attachment end, a neck, a body, watercourses on the body, blades, tips formed from grinding material on the blades, a central hole through the threads, neck, and body, and tip ports in fluid communication with the central hole such that fluids can be circulated through the mill, wherein the improvement comprises means for enhanced displacement of milled particles from the mill tips.

In the foregoing mill, the watercourses may be generally vertical.

In the foregoing mill, the watercourses may be generally helical.

A mill is provided for rotationally grinding and cutting an object in a well, the apparatus being attached to a rotation source such that the mill is rotated, the mill further being in circulatory fluid communication with a source of fluid from the surface the mill being rotated during grinding and cutting in a generally counterclockwise direction when viewed from the bottom of the well, the device comprising: (a) a neck, the neck having a top end, the top end being attached to the rotation source; (b) a body attached to the neck, the body having a length, the body having exterior watercourses along the length of the body, the body and the neck each having a central hole, the neck central hole being aligned with the body central hole; and (c) a plurality of tips, each tip having a blade and grinding material attached to the blade, the blades being attached to the body, the grinding material having tip ports, the tip ports being in fluid communication with the body central hole, each watercourse further having a first end proximate one of the tip ports, and a second end proximate the neck, each watercourse being generally helical from such watercourse's first end to second end the watercourse first end leading the second end during grinding and cutting.

The foregoing mill may further include the body, the body further having at least one reverse port, each reverse port exiting the body central hole and exiting the mill at a point which is higher than the point of exit from the body central hole.

The foregoing mill may also include at least two cutting inserts attached to each blade.

A mill is provided for rotationally grinding and cutting an object in a well, the apparatus being attached to a rotation source such that the mill is rotated, the mill further being in circulatory fluid communication with a source of fluid from the surface, the device comprising: (a) a neck, the neck having a top end, the top end being attached to the rotation source; (b) a body attached to the neck, the body having a length, the body having exterior watercourses along the length of the body, the body and the neck each having a central hole, the neck central hole being aligned with the body central hole, the body further having at least one reverse port, each reverse port exiting the body central hole and exiting the mill at a point which is higher than the point of exit from the body central hole; and (c) a plurality of tips, each tip having a blade and grinding material attached to the blade, the blades being attached to the body, the grinding material having tip ports, the tip ports being in fluid communication with the body central hole, each watercourse further having a first end proximate one of the tip ports.

The foregoing mill may also include the body watercourses, each watercourse further having a second end, each watercourse being generally helical from such watercourse's first end to the second end.

The foregoing mill may also include at least two cutting inserts attached to each blade.

The foregoing and other advantages will appear from the description to follow. In the description reference is made to the accompanying drawings, which form a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
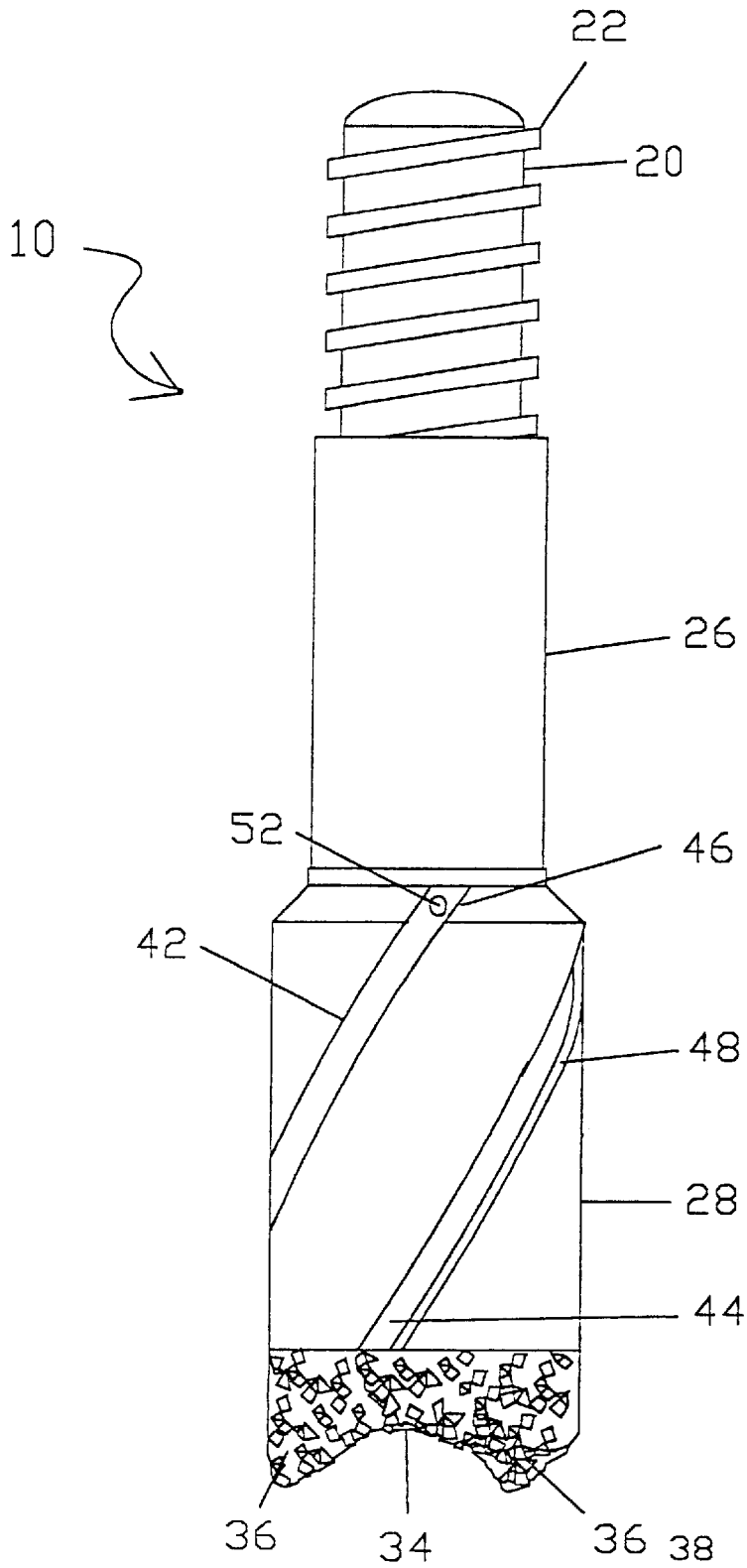
FIG. 1 is a side view of the preferred embodiment of the present invention, including both the helical watercourses and the reverse ports.

Turning now descriptively to the drawings, in which similar reference characters denote similar elements throughout the several views, the Figures illustrate the Improved Mill of the present invention. With regard to the reference numerals used, the following numbering is used throughout the various drawing figures.

10 Improved Mill of the present invention
12 prior art mill
14 prior art mill vertical watercourses
20 improved mill top end
22 improved mill top end threads
26 neck
28 body
30 blades
32 carbide cutting inserts
34 grinding material
36 tips
38 central hole
40 tip ports
42 helical watercourse
44 helical watercourse first end
46 helical watercourse second end
48 helical watercourse trailing side
50 vertical watercourse trailing side
52 reverse port
54 reverse port threads

DETAILED DESCRIPTION

Turning now descriptively to the drawings, in which similar reference characters denote similar elements throughout the several views, FIGS. 1—3 and FIGS. 5–6 illustrate the Improved Mill of the present invention indicated generally by the numeral 10.

Figure 4:
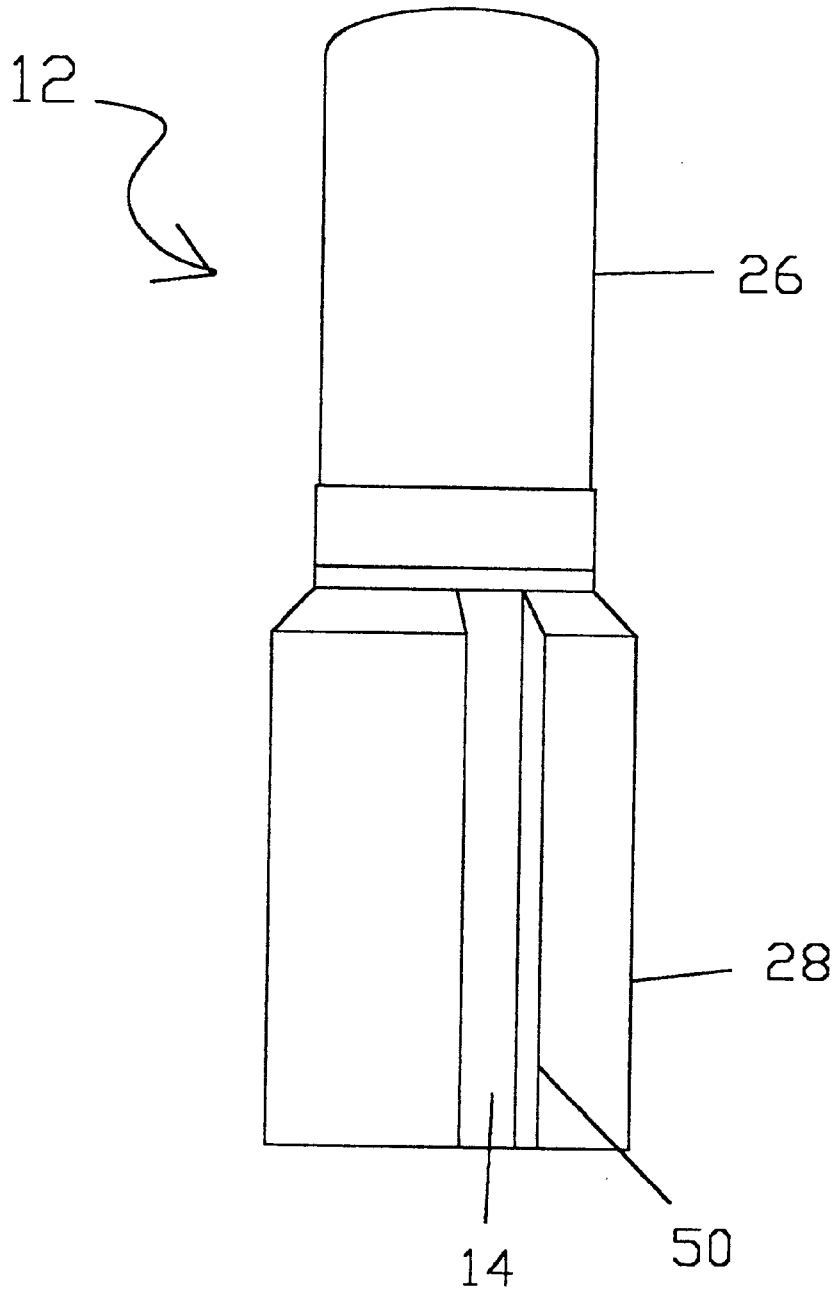
FIG. 4 is a side view of a prior art mill having vertical watercourses and no reverse ports.
Figure 5:
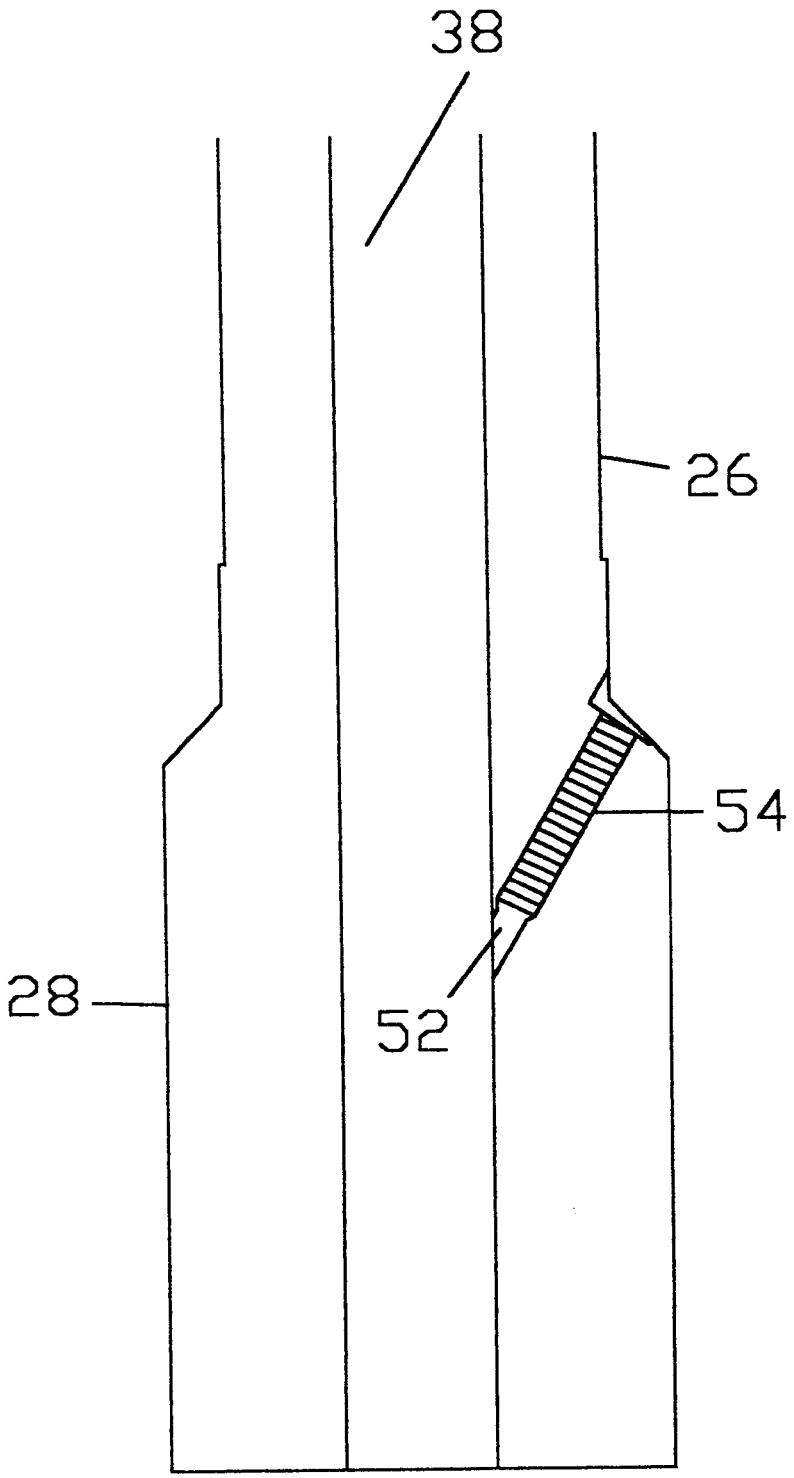
FIG. 5 is a representative side view, cutaway to show the positioning of the reverse port threads, in which a threaded plug may be inserted to close the reverse port.
Figure 6:
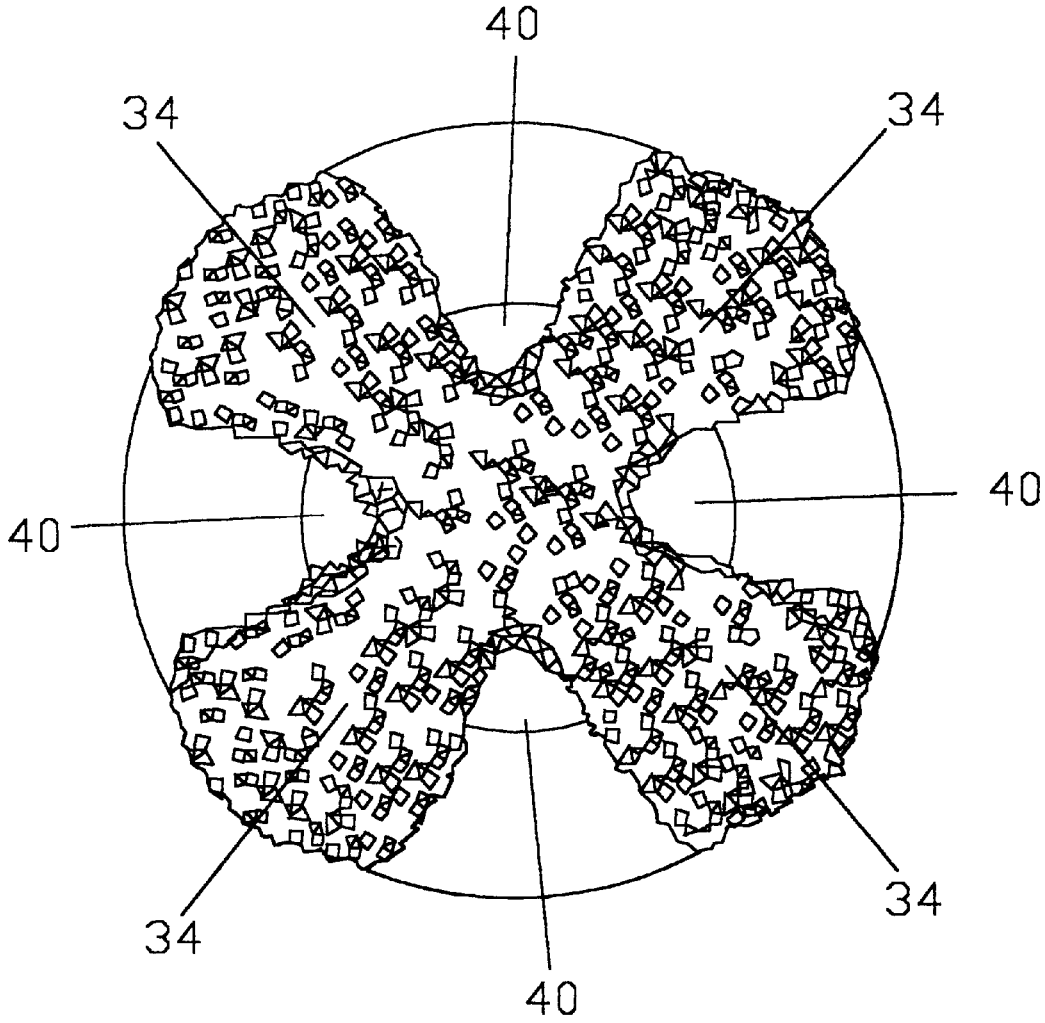
FIG. 6 is a bottom end view of the preferred embodiment of the invention depicting the grinding material and the tip ports.

The preferred embodiment of the improved mill 10 is shown in FIGS. 1–3 and FIGS. 5–6. A prior art mill 12 is depicted in FIG. 4. The prior art device 12 has the straight, vertical watercourses 14.

Figure 2:
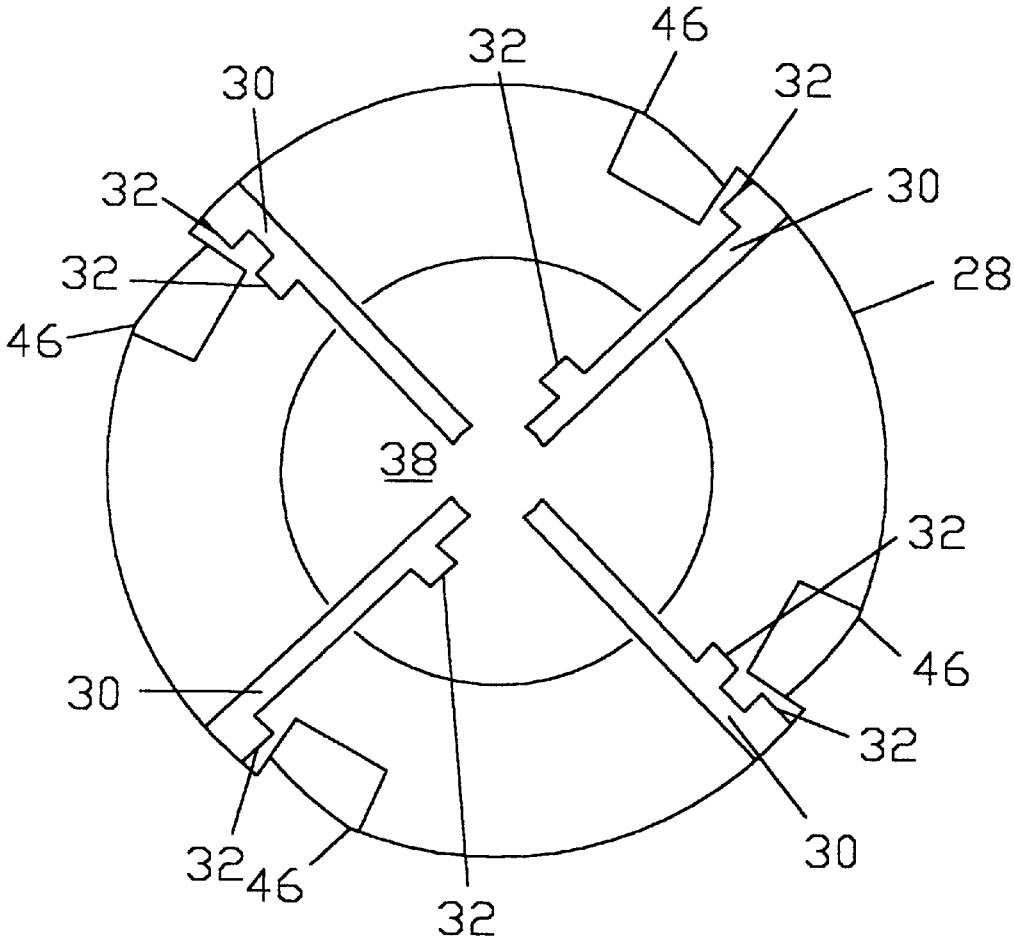
FIG. 2 is a bottom end view of the preferred embodiment of the present invention, with grinding material omitted from the blades, depicting in darkened profile, the carbide cutting inserts attached to the four blades.
Figure 3:
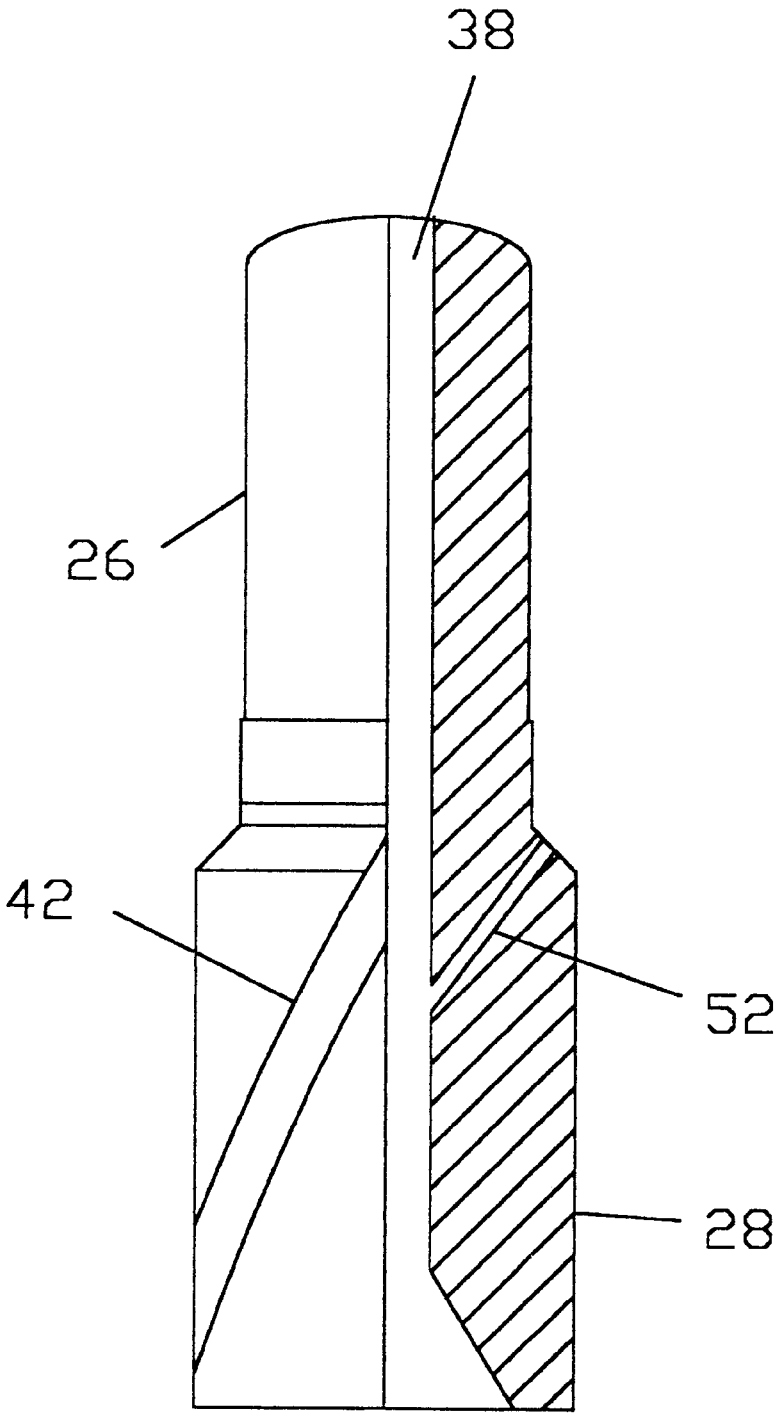
FIG. 3 is a side view of an embodiment of the improved mill showing the neck and body, with a portion cut away to show the path of one of the reverse ports from the mill's central hole to the neck vicinity.
Figure 7:
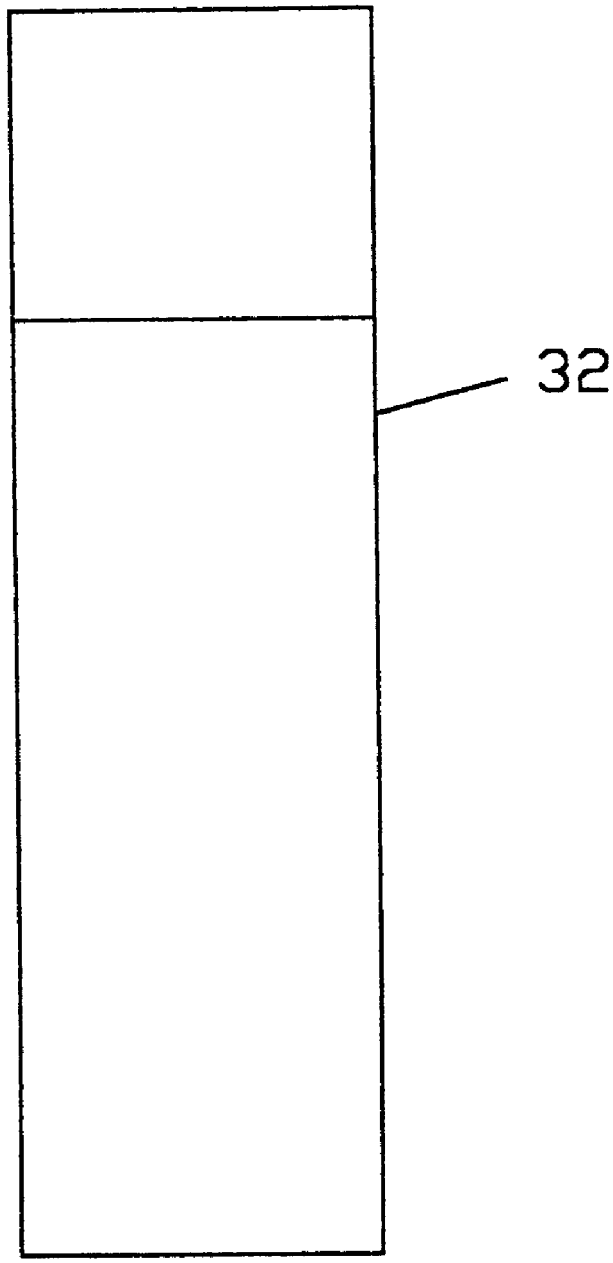
FIGS. 7–9 are side, front and oblique views of the preferred cutting insert, respectively.
Figure 8:
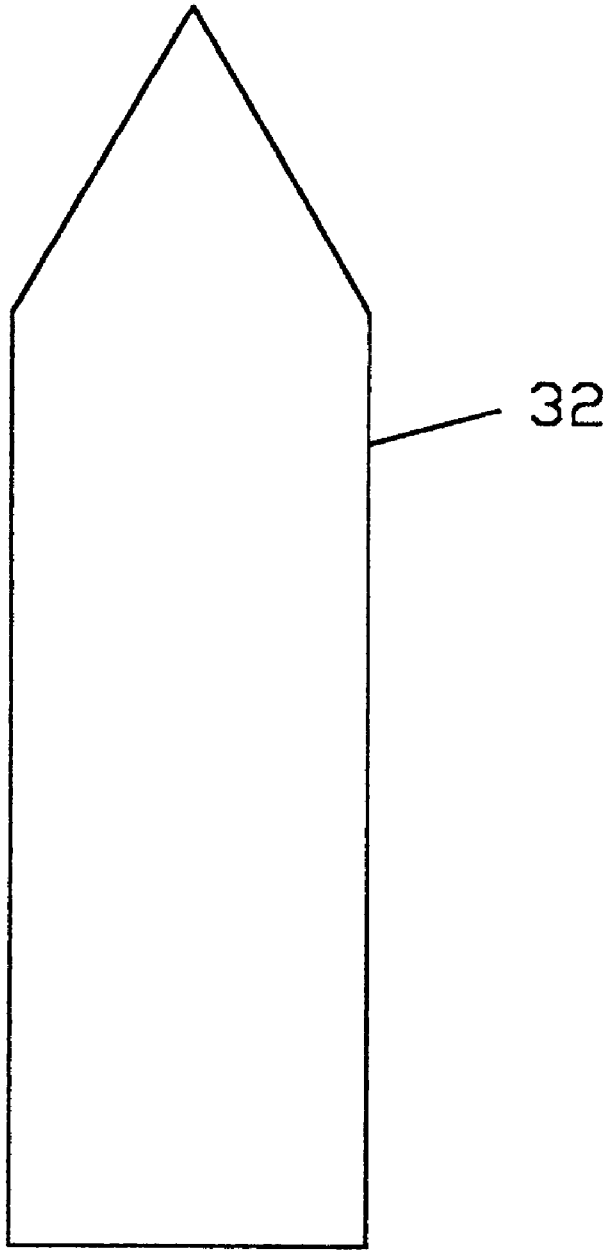
Figure 9:
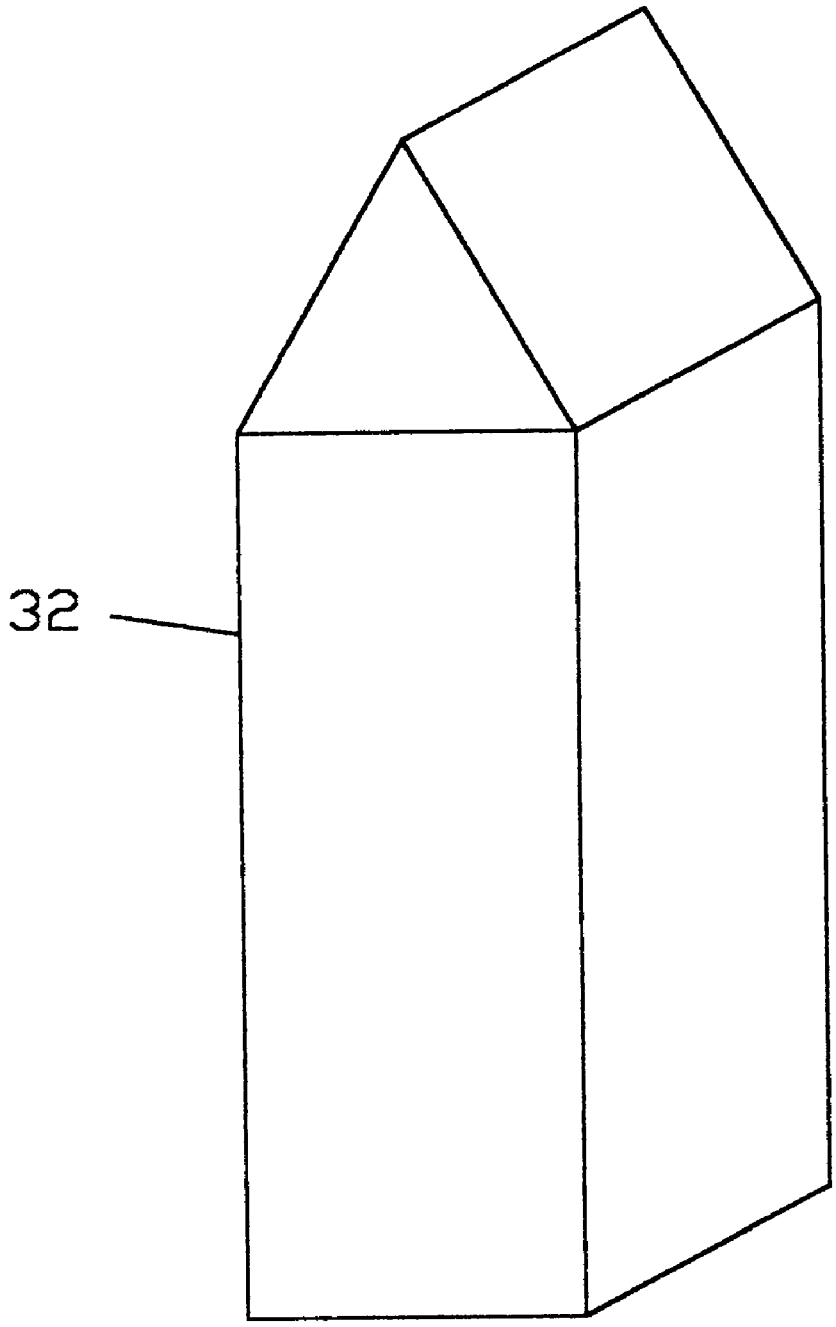

The improved mill 10 is made of steel, preferably 4140 heat-treated steel. A top end 20 is fitted, in this embodiment, with threads 22 for attachment to rotation devices, e.g. as a mud motor. Beneath the threads 22 is the neck 26 that joins the body 28. FIG. 2 depicts the blades 30 that are welded to the body 28. To these blades 30 are welded carbide cutting inserts 32. In the preferred embodiment, two inserts 32 are attached to each of the blades 30, as shown in FIG. 2. FIGS. 7–9 depict the shape of each insert 32. The chisel edge of each insert 32 is perpendicular to the blade 30, and is positioned to extend slightly below the blade 30. Both blades 30 and inserts 32 are then covered by grinding material 34 to form grinding tips 36. A central hole 38 extends throughout the top end 20, the neck 26 and body 28. Tip ports 40 are present between the blades 30 and through the grinding material 34.

Helical watercourses 42 have a first end 44 near the tip ports 40, and a second end 46 near the joinder of the neck 26 and body 28. The improved mill 10 rotates counterclockwise when viewed from the bottom end. When so rotated, the helical watercourse first end 44 leads the helical watercourse second end 46, such that a milled particle within the watercourse 42 will encounter a sloped helical watercourse trailing side 48.

The sloped face presented by the watercourse trailing side 48, encourages the particle to move on along the length of the helical watercourse 42. In the high speed environment of the improved mill 10, this is particularly important, since the vertical watercourse trailing edge 50 of the prior art mill 12 will tend to retain the particle against the watercourse trailing side 50 which bears upon the particle at high speed. Only water movement and the interaction with additional milled particles moving from the tips 36 tend to force the particle on through the vertical watercourse 14, unless the particle exits from the vertical watercourse 14 over the trailing side 50. Such an exit is undesirable in that unnecessary numbers of milled particles in the annulus between the mill 12 and the hole wall can reduce fluid circulation.

The ability of the circulation fluid to move milled particles away from the improved mill 10, is also enhanced by the presence of reverse ports 52 which establish circulation fluid communication between the central hole 38 and the area near the helical watercourse second end 46. As circulation fluid is pumped through the improved mill 10, some backpressure is created. This back pressure, and the U-tube effect created by the weight of the column of circulation fluid, causes a portion of the circulation fluid to be discharged into the annulus by the reverse ports 52.

This discharge introduces turbulence in an area of the annulus where milled particles are inclined to accumulate due to the drop in velocity from the smaller annulus to the larger annulus at the area near the neck 26. Such turbulence discourages milled particle settling and assists in the efficient transport of milled particles farther up the hole by the circulation fluid.

The reverse ports 52 form an angle of approximately 50 degrees from the horizontal and exit the central hole 38 approximately one-half the distance between the top and bottom of the body 28. It is believed that a reverse port 52 angle range of approximately 30 to 60 degrees will perform acceptably. It is preferable for the reverse ports 52 to exit the mill 10 near the end of the helical watercourse second ends 46, although benefit can still be derived using other exit points on the neck 26 or in the watercourse 42. Benefits of the reverse ports 52 do not require the watercourses 42 to be helical.

The preferred embodiment also includes closable reverse ports 52 that have threads 54, which can be closed by a threaded plug, such as a set screw (not shown).

The improved mill 10 can be sized to match the anticipated hole size, type of object to be milled, and anticipated types and volumes of circulation fluid. For smaller volumes of circulation fluid in the range of 30 to 50 gallons per minute, the outside diameter of the body 28 will typically be 1.75 to 2.25 inches, and the central hole 38 diameter will be approximately five-eighths of an inch. Rotation speed for this size body 28 will typically be 300 to 500 revolutions per minute. The outside diameter changes as sides are ground and polished off during repeated re-fabrications. It is believed that the ratio of the body surface area to helical watercourse area is optimized at approximately 3:1.

For medium circulation fluid volumes, an outside diameter of 2.25 to 2.75 inches is typical, with a central hole 38 internal diameter of three-fourths inch. This sizing will normally handle 40–70 gallons per minute, with rotation speeds normally being 300 to 450 revolutions per minute.

For large circulation fluid volumes, an outside diameter of 3 inches and larger is typical, with the central hole 38 internal diameter being approximately one inch. Circulation volumes in this case would be approximately 70 to 125 gallons per minute, and rotation speeds would typically be 150 to 300 revolutions per minute.

The blades 30 are made from one-fourth inch by one-inch cold drawn steel. The grinding material 34 is composed of tungsten carbide composite rod that is welded on to the blades 30. For body 28 diameters of over 3.75 inches the grinding material 34 will one-fourth to three-sixteenth inch mash, and three-sixteenth to one-eighth inch mash for body 28 diameters of 3.75 inches or less.

The reverse ports 52 are approximately five-sixteenths inches internal diameter, with the threaded portion 54 being approximately three-fourths inches.

Although particular types of materials and particular dimensions have been discussed herein, other types and sizes of materials, such as various grades of steel, can also be used, all in accordance with the present invention, and as determined by the intended end use for the overall device, as will occur to those of skill in the art upon review of the present disclosure.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various milling applications without omitting features that, from the standpoint of prior art, fairly constitute essential characteristics of the generic or specific aspects of this invention.

What is claimed is:

1. A mill for grinding objects in wells, the mill being of the type having an attachment end, a neck, a body, watercourses on the body, blades, tips formed from grinding material on the blades, a central hole through the attachment end, neck, and body, and tip ports in fluid communication with the central hole such that fluids can be circulated through the mill, the mill being rotated during grinding in a generally counterclockwise direction when viewed from the bottom of the well, wherein the improvement comprises:

(a) the watercourses, each watercourse having a first end, each first end being proximate a tip port, each watercourse further having a second end, each second end being proximate the neck, and further each watercourse being generally helical from the first end to the second end, the watercourse first end leading the second end during grinding.

2. The mill of claim 1, wherein the number of watercourses is four.

3. The mill of claim 1, wherein the watercourses form an angle with the horizontal, the angle being approximately 60 degrees.

4. The mill of claim 1, wherein the watercourses divide the body into portions, each body portion having a width, and each watercourse having a width, each body portion width being substantially larger than each watercourse width.

5. The mill of claim 4, wherein the ratio of one of the body portion widths to one of the watercourse widths is approximately 3:1.

6. The mill of claim 1, further comprising at least one cutting insert attached to one or more of the blades.

7. The mill of claim 1, further comprising the body, the body having at least one reverse port, each reverse port exiting the mill central hole from within the body, and exiting the mill at a point higher than the point of exit from the mill central hole.

8. The mill of claim 7, wherein at least one of the reverse ports is closable.

9. The mill of claim 7, wherein at least one of the reverse ports is threaded proximate the watercourse.

10. The mill of claim 9, further comprising at least one plug for threadably coupling with the at least one threaded reverse port, such coupling closing the reverse port.

11. The mill of claim 7, wherein the angle of each of the reverse ports is from approximately 30 to 60 degrees from the horizontal.

12. A mill for grinding objects in wells, the mill being of the type having an attachment end, a neck, a body, watercourses on the body, blades, tips formed from grinding material on the blades, a central hole through the attachment end, neck, and body, and tip ports in fluid communication with the central hole such that fluids can be circulated through the mill, wherein the improvement comprises:

(a) the body, the body further comprising at least one reverse port, each reverse port exiting the mill central hole from within the body, and exiting the mill at a point higher than the point of exit from the central mill hole.

13. The mill of claim 12, wherein at least one of the reverse ports is closable.

14. The mill of claim 12, wherein at least one of the reverse ports is threaded proximate the watercourse.

15. The mill of claim 14, further comprising at least one plug for threadably coupling with the at least one threaded reverse port, such coupling closing the reverse port.

16. The mill of claim 12, wherein the angle of each of the reverse ports is from approximately 30 to 60 degrees from the horizontal.

17. The mill of claim 12, further comprising the watercourses, each watercourse having a first end, each first end being proximate a tip port, each watercourse further having a second end, each second end being proximate the neck, and further each watercourse being generally helical from the first end to the second end.

18. The mill of claim 17, wherein the number of watercourses is four.

19. The mill of claim 17, wherein the watercourses form an angle with the horizontal, the angle being approximately 60 degrees.

20. The mill of claim 17, wherein the watercourses divide the body into portions, each body portion having a width, and each watercourse having a width, each body portion width being substantially larger than each watercourse width.

21. The mill of claim 20, wherein the ratio of one of the body portion widths to one of the watercourse widths is approximately 3:1.

22. The mill of claim 12, further comprising at least one cutting insert attached to one or more blades.

23. The mill of claim 12, wherein each reverse port exits the mill proximate the neck and proximate one of the watercourses.

24. A mill for grinding objects in wells, the mill being of the type having an attachment end, a neck, a body, watercourses on the body, blades, tips formed from grinding material on the blades, a central hole through the attachment end, neck, and body, and tip ports in fluid communication with the central hole such that fluids can be circulated through the mill, wherein the improvement comprises:

(a) means for enhanced displacement of milled particles from the mill tips.

25. The mill of claim 24, wherein the watercourses are generally vertical.

26. The mill of claim 24, wherein the watercourses are generally helical.

27. A mill for rotationally grinding and cutting an object in a well, the apparatus being attached to a rotation source such that the mill is rotated, the mill further being in circulatory fluid communication with a source of fluid from the surface, the mill being rotated during grinding and cutting in a generally counterclockwise direction when viewed from the bottom of the well, the device comprising:

(a) a neck, the neck having a top end, the top end being attached to the rotation source;

(b) a body attached to the neck, the body having a length, the body having exterior watercourses along the length of the body, the body and the neck each having a central hole, the neck central hole being aligned with the body central hole; and (c) a plurality of tips, each tip having a blade and grinding material attached to the blade, the blades being attached to the body, the grinding material having tip ports, the tip ports being in fluid communication with the body central hole, each watercourse further having a first end proximate one of the tip ports, and a second end proximate the neck, each watercourse being generally helical from such watercourse's first end to second end, the watercourse first end leading the second end during grinding and cutting.

28. The mill of claim 27, further comprising the body, the body further having at least one reverse port, each reverse port exiting the body central hole and exiting the mill at a point which is higher than the point of exit from the body central hole.

29. The mill of claim 27, further comprising at least two cutting inserts attached to each blade.

30. A mill for rotationally grinding and cutting an object in a well, the apparatus being attached to a rotation source such that the mill is rotated, the mill further being in circulatory fluid communication with a source of fluid from the surface, the device comprising:

(a) a neck, the neck having a top end, the top end being attached to the rotation source;

(b) a body attached to the neck, the body having a length, the body having exterior watercourses along the length of the body, the body and the neck each having a central hole, the neck central hole being aligned with the body central hole, the body further having at least one reverse port, each reverse port exiting the body central hole and exiting the mill at a point which is higher than the point of exit from the body central hole; and (c) a plurality of tips, each tip having a blade and grinding material attached to the blade, the blades being attached to the body, the grinding material having tip ports, the tip ports being in fluid communication with the body central hole, each watercourse further having a first end proximate one of the tip ports.

31. The mill of claim 30, further comprising the body watercourses, each watercourse further having a second end, each watercourse being generally helical from such watercourse's first end to the second end.

32. The mill of claim 30, further comprising at least two cutting inserts attached to each blade.

* * * * *